US005664527A

United States Patent [19]

Boudy

[11] Patent Number: 5,664,527

[45] Date of Patent: Sep. 9, 1997

[54] PNEUMATIC VALVE RECOIL SYSTEM FOR INTERNAL COMBUSTION ENGINES

[75] Inventor: Jean-Pierre Boudy, Bièvres, France

[73] Assignees: Automobiles Peugeot, Paris; Autmobiles Citroen, Neuilly-sur-Seine, both of France

[21] Appl. No.: 496,180

[22] Filed: Jun. 28, 1995

[30] Foreign Application Priority Data

Oct. 29, 1993 [FR] France ..... 93.12913

[51] Int. Cl.[6] ..... F01L 3/10

[52] U.S. Cl. ..... 123/90.14; 123/90.65; 123/90.12; 123/188.17; 251/337

[58] Field of Search ..... 123/90.12, 90.14, 123/90.65, 90.66, 188.12, 188.17; 251/337

[56] References Cited

U.S. PATENT DOCUMENTS 5,553,572 9/1996 Ochiai ..... 123/90.65

5,558,054 9/1996 Ariga et al. ..... 123/90.65

FOREIGN PATENT DOCUMENTS 0 396 327 11/1990 European Pat. Off. .

0 536 513 4/1993 European Pat. Off. .

3 808 542 10/1988 Germany .

61-149510 7/1986 Japan ..... 123/90.65

6-17611 1/1994 Japan ..... 123/90.65

*Primary Examiner*—Weilun Lo

*Attorney, Agent, or Firm*—Burns, Doane, Swecker & Mathis, L.L.P.

[57] ABSTRACT

A pneumatic valve recoil system includes a piston that is unitary with the stem of a valve and which slides in a cylinder, such that the piston, valve stem, and cylinder cooperate to form a chamber containing a compressible fluid. The chamber is connected through a single calibration port to an oil-evacuation and fluid-pressure-regulating system located outside the cylinder head of the engine.

22 Claims, 9 Drawing Sheets

PNEUMATIC VALVE RECOIL SYSTEM FOR INTERNAL COMBUSTION ENGINES

BACKGROUND OF THE INVENTION

This invention concerns a pneumatic valve recoil system for an internal combustion engine, usable primarily—but not exclusively—for automotive purposes.

In order to ensure proper operation of the motor, a recoil system needs to be used to keep the intake and exhaust valves in the closed position, with said valves opening at the desired time by the action of cams or rocker arms actuated by a cam shaft.

The recoiling of valves is generally done by using metal helical springs, but these springs have a certain number of drawbacks, particularly the phenomenon known by the name of "valve flutter."

It is a known fact that the natural vibrational frequency of a spring drops as its deflection increases. This is how valve springs start to vibrate at relatively slow engine speeds when the valve lift has been designed to be large. The result on this type of engine is excessively low power at high engine speeds in spite of the good theoretical admission. This is why pneumatic systems have been proposed for valve recoiling.

Document FR-A-2529616 describes such a system in which the valve stem is one with a piston sliding in a cylinder, which together define a chamber filled with a compressible fluid such as air. Since the chamber cannot be perfectly sealed,l air leaks and oil infiltration still occur. For this reason an air-supply and oil-evacuation system using lines with calibrated valves is provided, in which the lines are made in the bodies of the pneumatic springs which are in turn installed in the engine's cylinder head.

This system, however, is complex to make because many passages have to be drilled, and it requires delicate adjustment since a large number of springs need to be installed and calibrated.

SUMMARY OF THE INVENTION

This invention, therefore, is intended to eliminate these drawbacks by proposing a pneumatic spring recoil system that is simpler to make, and consequently less costly, and easier to use.

According to the primary feature of the recoil system disclosed herein, the system-which comprises a piston that is unitary with a valve stem and slides within a cylinder, with the piston, valve stem, and cylinder forming a chamber containing a compressible fluid—is characterized by the fact that said chamber is connected through a single calibration port to an oil-evacuation and fluid-pressure-regulating system located outside the engine's cylinder head.

The term "single calibration port" used here means that there is only one calibration port associated with a given chamber.

According to other features of the recoil system concerned by this invention:

- the calibration port is linked to a collection manifold communicating with the oil-evacuation and pressure-regulating system;
- the diameter of the calibration port is between 0.5 and 1.5 mm;
- it includes two oil-evacuation and pressure-regulating systems in order to provide redundancy;
- a non-transfer valve capable of preventing the transfer of oil when the lateral acceleration exceeds a predetermined threshold is installed between the two oil-evacuation and pressure-regulating systems;
- the oil-evacuation and pressure-regulating system includes a container whose upper portion communicates both with the calibration port and with a source of pressurized gas, if necessary through a calibrated valve, and whose lower portion, where the oil accumulates, communicates with an evacuation line equipped with at least one device controlling oil evacuation;
- the device controlling oil evacuation is sensitive to the pressure in said container;
- the device controlling oil evacuation is sensitive to the oil level in the container;
- the device controlling oil evacuation is a solenoid valve;
- the device controlling oil evacuation is a diaphragm valve;
- the diaphragm valve includes a body separated by a diaphragm into one compartment where said evacuation line leads, and a second compartment containing recoiling means pressing the diaphragm against the opening of a line made in the first compartment;
- the diaphragm recoiling means is mechanical, such as a spring;
- the diaphragm recoiling means is pneumatic, with the second compartment communicating with the pressurized gas source through a line;
- said line is equipped with a solenoid valve which is caused to open when the pressure variations in the container exceed a predetermined threshold;
- said solenoid valve is controlled by an engine management system according to the indications of a sensor measuring the pressure in the collection manifold;
- the system includes means of detecting the oil level in the container;
- the oil-level detection means includes a float capable of actuating contacts connected to an engine management system;
- the oil-level detection means includes a float hinged at its lower end on the end of a lever whose other end acts on a calibrated valve ball in such a way as to open the valve if the oil level rises above a predetermined threshold;
- the oil-level detection means includes a hot-wire sensor;
- the system includes means for evacuating any oil accumulating in the collection manifold;
- the means for evacuating the oil from the collection manifold includes a solenoid valve installed in parallel with said calibrated valve between the pressurized gas source and the collection manifold, with the container being installed downstream of the manifold with respect to the calibrated valve, and the solenoid valve being caused to open at a predetermined frequency; and
- opening of said solenoid valve is controlled according to the number of engine cycles and/or the oil level in the container.

BRIEF DESCRIPTION OF THE DRAWINGS

The invention will be clearer upon reading the following description given only as an example, in connection with the appended drawings wherein like reference numerals are applied to like elements and in which.

DETAILED DESCRIPTION OF THE PREFERRED EMBODIMENTS

Figure 1:
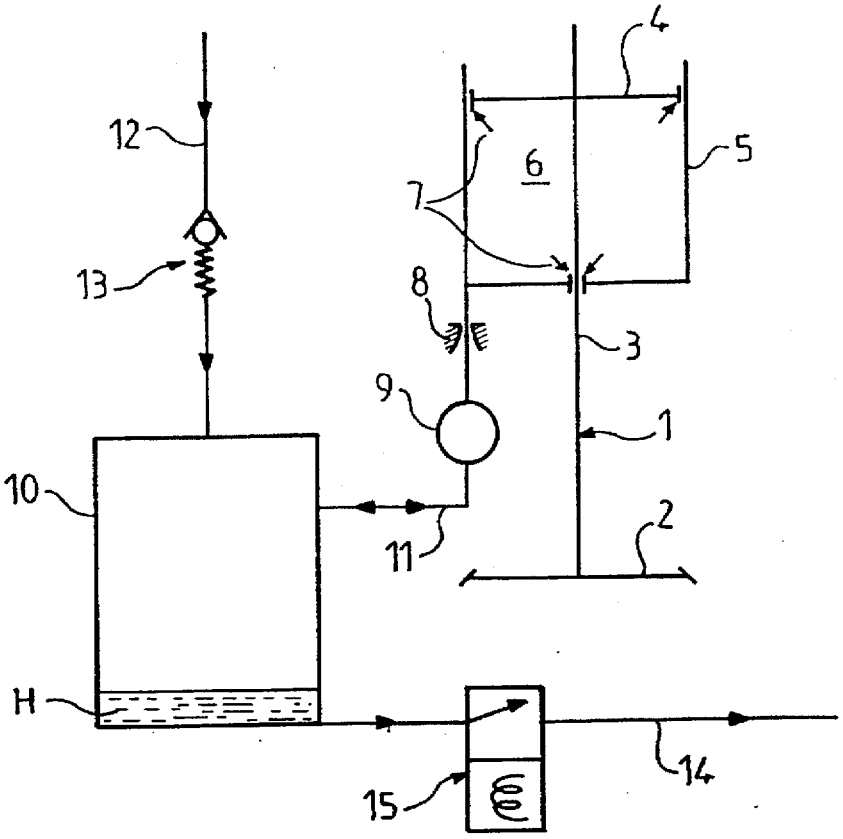
FIG. 1 is a schematic diagram illustrating the principle of the invention according to an initial embodiment.

FIG. 1 is a schematic diagram showing valve 1 having head 2 and stem 3. The end of the stem opposite head 2 is unitary with piston 4 which slides in cylinder 5. Piston 4, cylinder 5, and stem 3 form an actuator and, inside the cylinder, form chamber 6 filled with a compressible fluid (generally a gas such as air) which constitutes the valve's pneumatic recoil spring which returns the valve to its closed position. The sealed condition between cylinder 5 and piston 4 or stem 3 is provided by dynamic seals 7 which stand up well to friction, wear, and high temperatures.

In spite of the quality of the seals, it is impossible to prevent air leaks from chamber 6 to the outside and oil penetration into the chamber. For this reason, an air supply system and an oil evacuation system need to be provided.

According to the invention, these two functions are performed by means of calibration port 8 in combination with each actuator. The various ports, item 8, communicate with collection manifold 9 built into the cylinder head and in turn connected to an air-supply and oil-evacuation system. This system consists primarily of container 10 connected to manifold 9 by line 11. Container 10 is kept at a constant pressure (such as 10 bars, for example) by a pressure source (not shown in FIG. 1) to which it is connected by line 12 equipped with calibrated valve 13. A compressor or a small-volume compressed gas tank (for example, 1 liter) on the vehicle can constitute the pressure source.

It is therefore clear that, if the pressure inside chamber 6 drops below a certain value (for example, at the end of the rising motion of the valve to its closed position as shown in FIG. 1), the chamber is supplied with air from container 10 through line 11, manifold 9, and calibration port 8. Conversely, if the pressure increases to a sufficiently high value (for example, during a compression stroke of piston 4), any oil which was able to penetrate chamber 6 is expelled through port 8, manifold 9, and line 11 and into container 10 where it collects at the bottom (indicated as item H in FIG. 1). It is then evacuated (preferably to the engine crankcase) through line 14 equipped with solenoid valve 15, which is actuated by the engine's electronic management system (not shown).

Figure 2:
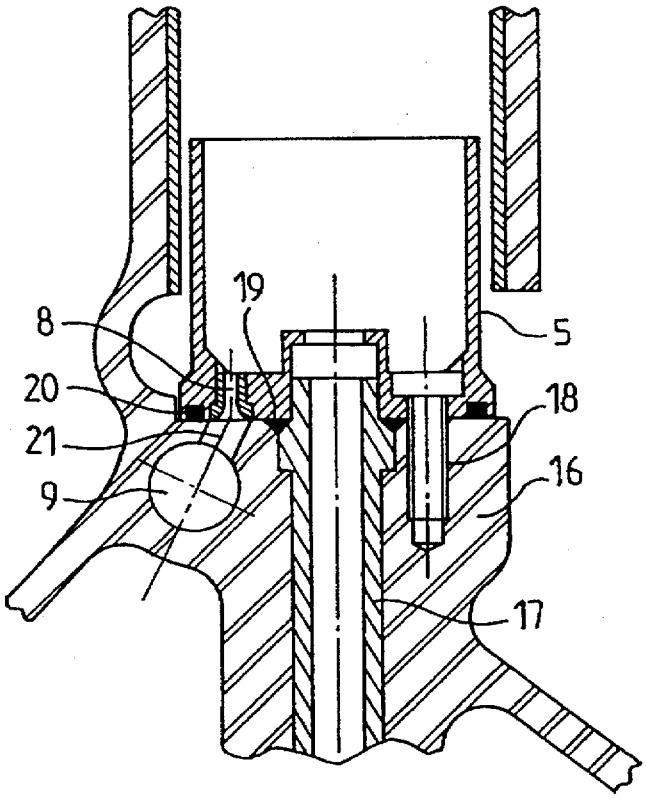
FIG. 2 is a cross-sectional drawing showing the placement of the system concerned by this invention, inside the cylinder head of an internal combustion engine.

The placement of the system in the engine's cylinder head is shown in the cross-sectional drawing in FIG. 2. Cylinder head 16 is machined by known means in order to accommodate valve guide 17 and a part forming cylinder 5 attached to the cylinder head with screws 18. Gaskets 19 and 20 provide sealing between cylinder head 16, guide 17, and cylinder 5. The bottom of the cylinder is relatively thick and has a hole drilled in it constituting the aforementioned calibration port 8 which communicates with collection manifold 9 through hole 21. The air-supply and oil-evacuation system is outside the cylinder head and is not shown in FIG. 2.

Figure 3:
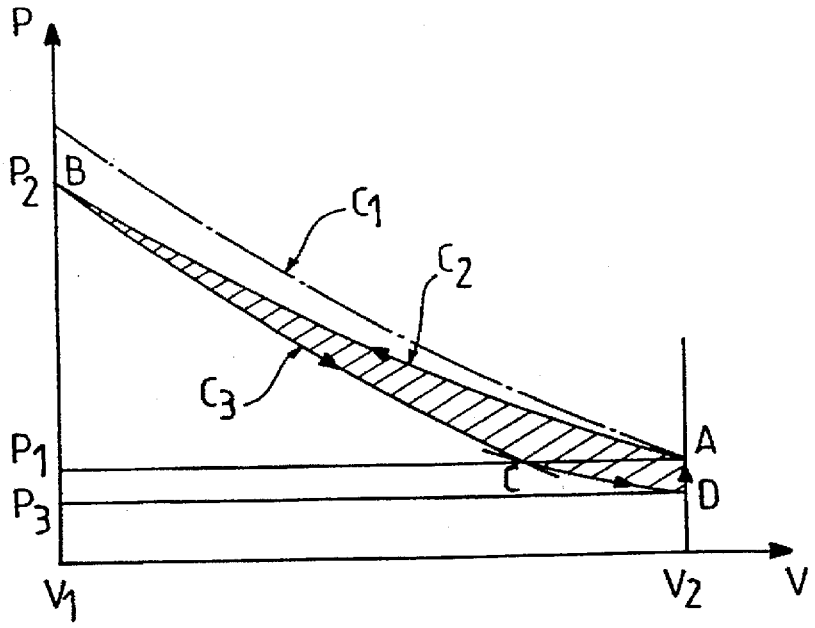
FIG. 3 is a graph showing the change in pressure during one cycle in a valve actuator equipped with the system of this invention.
Figure 4:
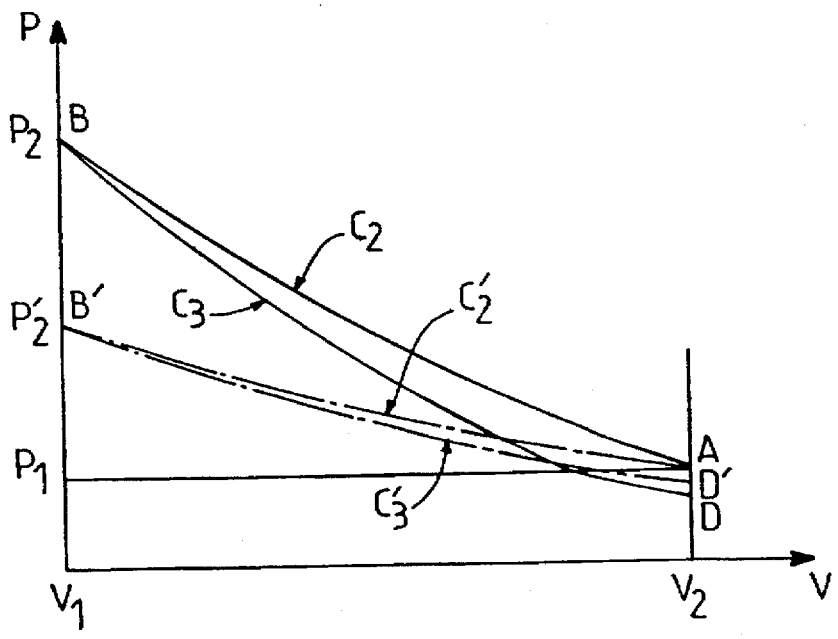
FIG. 4 is a graph similar to FIG. 3, showing how this cycle changes between high speeds and low speeds.
Figure 5:
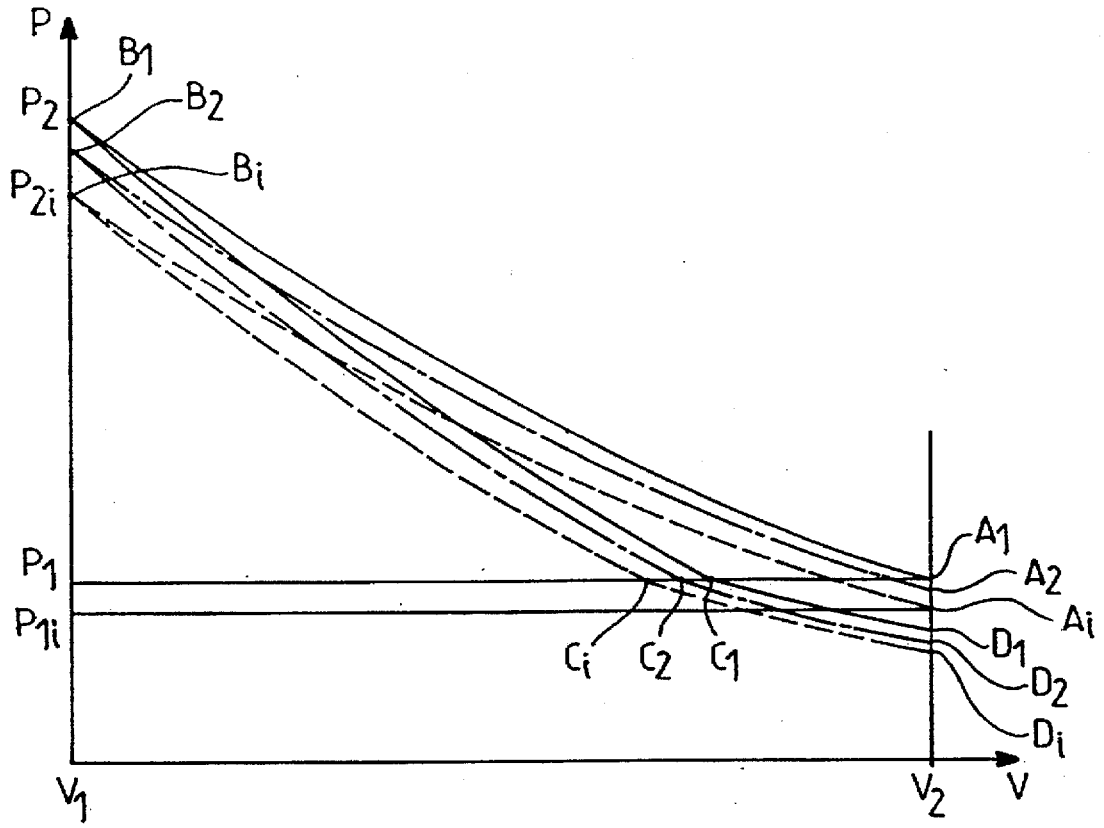
FIG. 5 is a graph similar to FIGS. 3 and 4, showing how this cycle stabilizes over time.

We shall now describe the operation of the system concerned by this invention, particularly in connection with FIGS. 3 through 5 which are graphs showing how pressure P inside chamber 6 varies as a function of the chamber's change in volume V during a cycle: values $V_1$ and $V_2$ are the minimum and maximum volumes of volume V corresponding to the travel limits of piston 4.

We shall first assume that piston 4 is in the position illustrated in FIG. 1: the volume of chamber 6 is equal to $V_2$ and the pressure inside the chamber is equal to $P_1$, which corresponds to point A in FIG. 3. During a compression stroke of the piston, if the chamber were perfectly sealed, curve $C_1$ shown with a dot-and-dash line would be followed. However, since air escapes through port 8, curve $C_2$ is followed up to point B corresponding to pressure $P_2$, which is less that it would have been had curve $C_1$ been followed. For this same reason, during the following expansion stroke of the actuator, instead of curve $C_2$, curve $C_3$, which corresponds to a lower pressure, is followed. Upon reaching point C, corresponding to the minimum calibration pressure of chamber 6, there is an inflection in the curve because the actuator is resupplied with air by the air-supply system. We consequently arrive at point D at the end of the stroke with a pressure $P_3$ less than $P_1$, then the chamber continues to fill with air at constant volume until pressure $P_1$ is restored, which corresponds to segment DA.

It should be noted that the cycle just described varies according to the engine speed. This is illustrated in FIG. 4 where cycle ABD is again shown for high-speed operation: the pressure increases sharply during a compression stroke. At low speeds the flow of air through calibration port 8 increases because the piston's movement is slower: curve $C'_2$ is followed from A to B' corresponding to pressure $P'_2$ which is less than $P_2$, then curve C' from B' to D'.

It is also possible that, depending on the system adjustment and the engine speed, the actuator may not have enough time to reinflate at the end of a cycle. In this case, at the end of the first cycle $A_1B_1C_1D_1$ (FIG. 5), instead of being at point $A_1$, we end up at point $A_2$ which corresponds to a lower pressure. The following cycle will be $A_2B_2C_2D$, and then the system will stabilize after $A_iB_iC_iD_i$; everything happens as if the supply pressure were equal to $P_{1i}$, which is slightly lower than $P_1$, with $P_{1i}$ corresponding to point $A_i$.

It is therefore understandable that cycle ABCD is controlled by choosing the diameter of port 8 and the calibration pressure of container 10.

We shall now describe various embodiments of the system concerned by this invention in reference to FIGS. 6 through 14.

Figure 6:
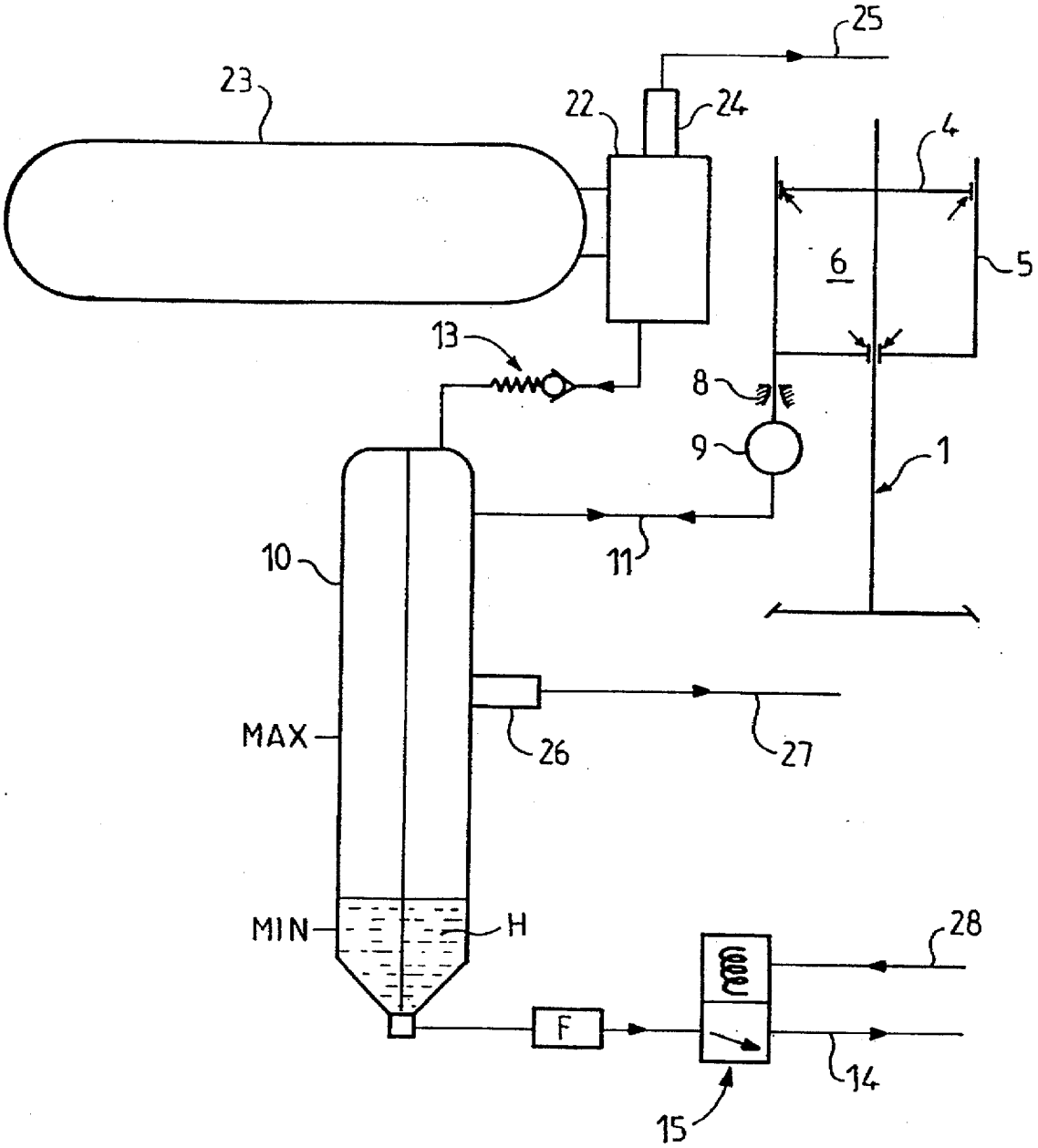
FIG. 6 is a diagram similar to FIG. 1, illustrating a second embodiment of the system concerned by the invention.

Referring first to FIG. 6, we see valve 1 and actuator 4-5-6 as well as calibration port 8, manifold 9, and container 10. The container communicates through calibrated valve 13 with pressure reducing valve 22 of compressed gas tank 23, which is carried on the vehicle and which contains, for example, a liter of air at 200 bars. Pressure reducing valve 22 is equipped with pressure sensor 24 which is connected to the engine management system by line 25 and which serves to check the pressure in tank 23.

Container 10 is also equipped with a pressure sensor, item 26, connected to the engine management system by line 27.

Line 14 is equipped with filter F and solenoid valve 15 is connected to the management system by line 28.

As an example, the diameter of calibration port 8 can be between 0.5 and 1.5 mm, pressure reducing valve 22 adjusted to provide a pressure of 10.5 bars, and valve 13 causing a pressure drop of 0.5 bar in order to keep container 10 at 10 bars.

Under these conditions, the pressure in the valve's recoil actuator varies between 10 and 25 bars, with the pressure in manifold 9 and container 10 remaining more or less constant.

As oil H collects at the bottom of container 10, the volume of gas contained in this container changes along with its pressure. Since the pressure must be kept as even as possible, oil evacuation will be triggered by the opening of solenoid valve 15 either when the pressure reaches a preset maximum value (for example, 11 bars) or when the oil reaches the maximum level marked "MAX" in FIG. 6. Evacuation is stopped when the pressure returns to its initial level of 10 bars or when the oil reaches the minimum level marked "MIN."

Figure 7:
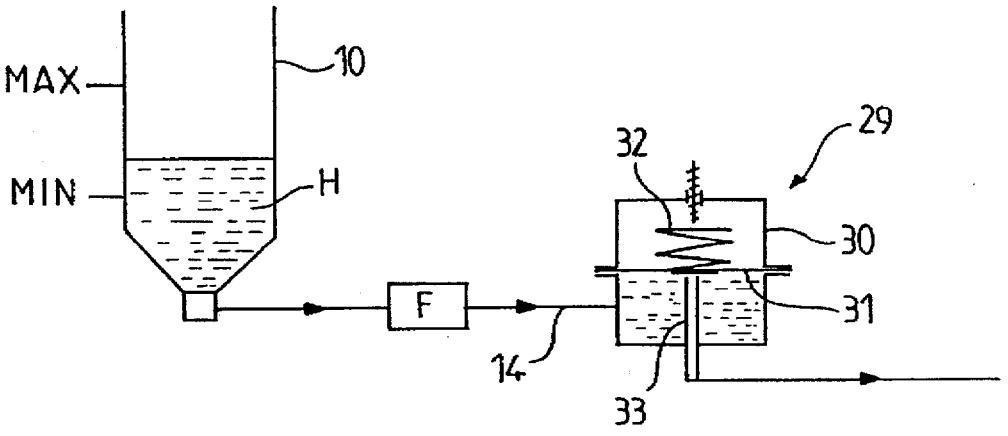
FIGS. 7 through 9 are diagrams illustrating three possible embodiments for the oil evacuation system.

FIG. 7 shows a variation of the oil-evacuation system in which solenoid valve 15 is replaced with diaphragm valve 29.

This valve consists of body 30 separated by diaphragm 31 into a lower compartment where the oil arriving through line 14 collects, and an upper compartment containing spring 32 which pushes diaphragm 31 against the opening of tube 33.

As the pressure increases in container 10, the increase is transmitted to the volume of oil which causes diaphragm 31 to be lifted and the oil to be evacuated through tube 33.

Figure 8:
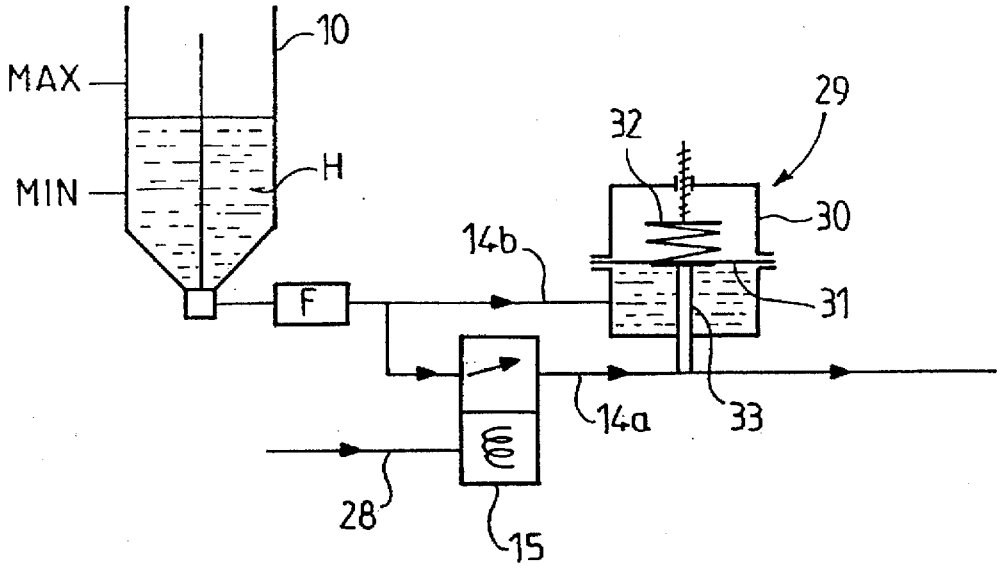

As a safety measure, it may be useful to provide a double evacuation system by installing a solenoid valve and a diaphragm valve in parallel as illustrated in FIG. 8. All the components already described have the same references, with the exception of line 14 which is divided among line **14*a* containing the solenoid valve and line 14*b*** containing the diaphragm valve.

Indeed, container 10 may have a slight leak and its pressure may not increase even if the oil exceeds its maximum level. In this case, valve 29 will not be triggered and evacuation will instead be ensured by the solenoid valve which is sensitive to the oil level. Conversely, the diaphragm valve will take over from the solenoid valve if the solenoid valve should fail.

Figure 9:
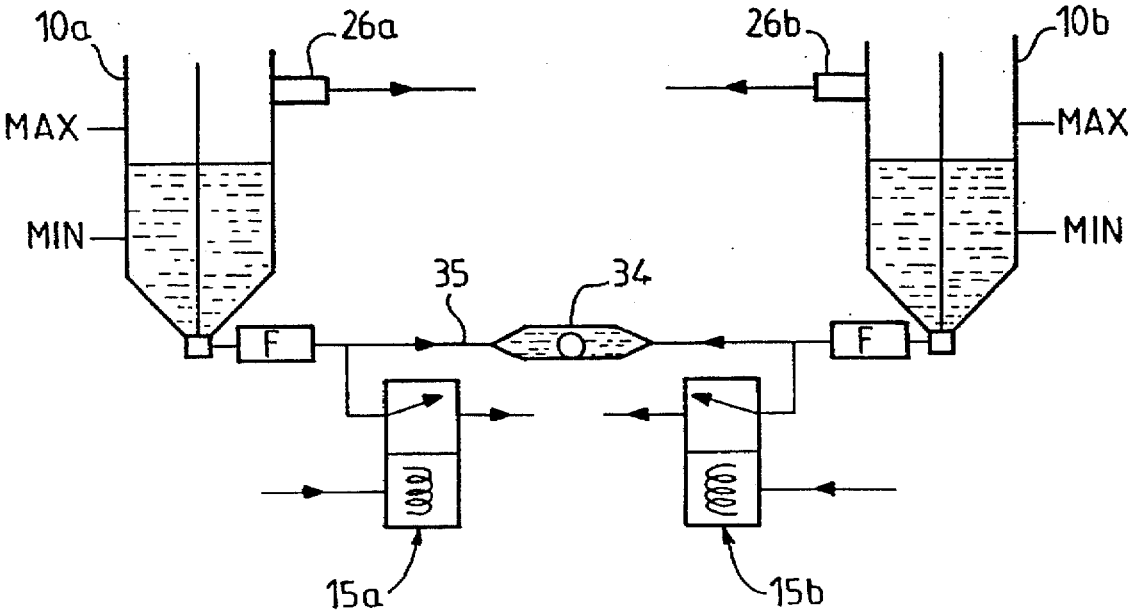

In the case of an engine with two banks of cylinders, dual air-supply and oil-evacuation systems can be provided in order to ensure safety through redundancy. FIG. 9 shows how the solenoid-valve evacuation system of FIG. 7 was backed up, with the corresponding components having the same references followed by the index a or b to differentiate between the two sides of the engine. Note that anti-transfer valve 34 is placed in line 35 connecting containers **10*a* and 10*b* in order to prevent any transfer from one container to the other in the event of a large lateral acceleration. If there is little or no lateral acceleration, the valve is left open and, for example, will allow the oil in container 10*a* to evacuate through solenoid valve 15*b***.

Naturally, a dual system can be used to provide redundancy even if there is only one bank of cylinders.

Figure 10:
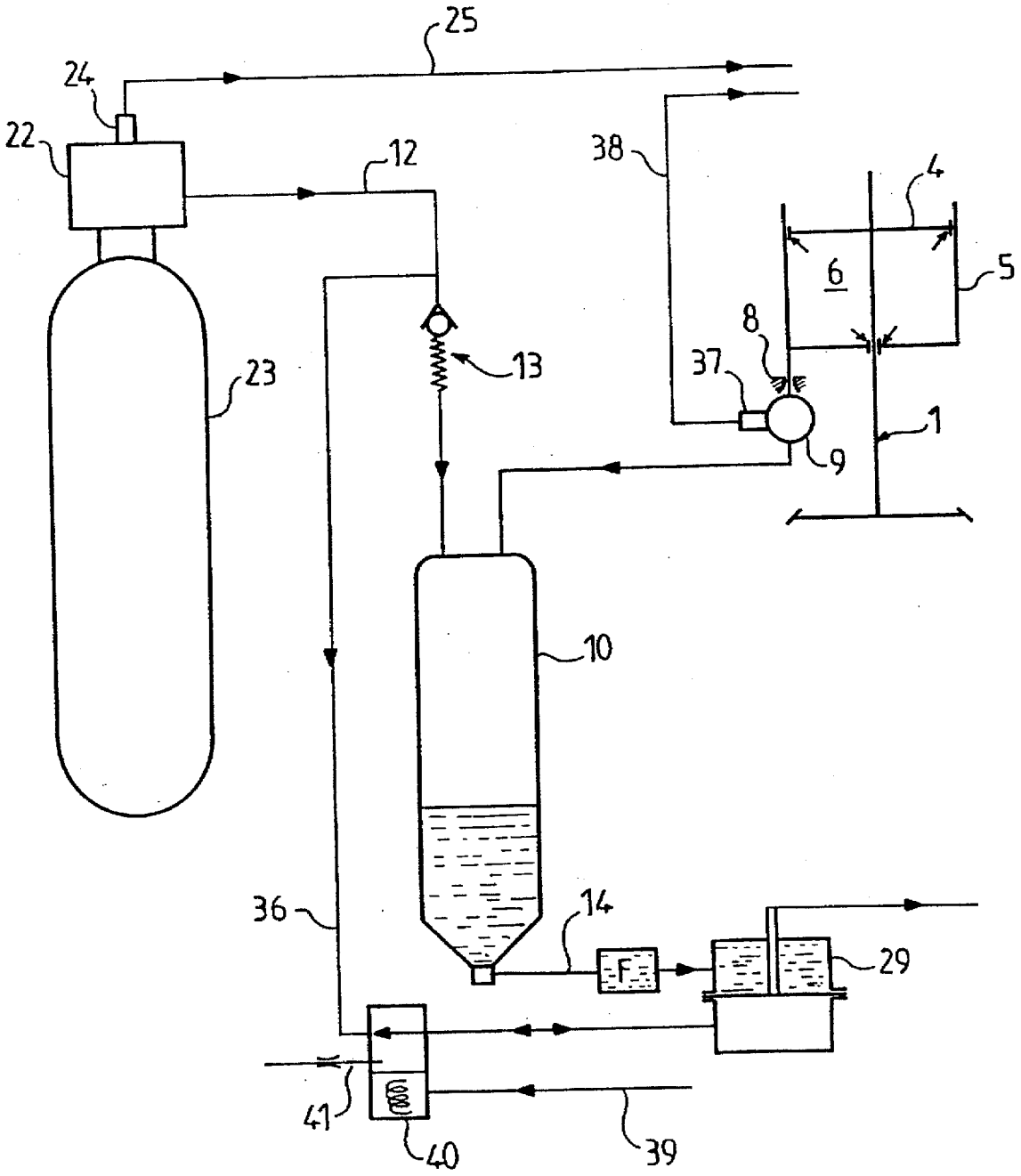
FIGS. 10 through 14 are drawings similar to FIG. 1, illustrating other embodiments of the system concerned by the invention.
Figure 11:
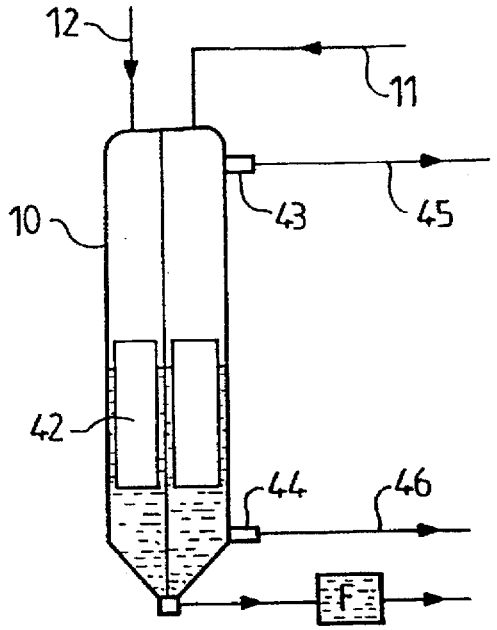

In the variation of FIG. 10, we see the same components as in FIGS. 6 through 8, except that spring 32 of diaphragm valve 29 has been eliminated: the corresponding compartment is kept under pressure by line 36 which connects it to line 12 at a point located between pressure reducing valve 22 and valve 13.

Here again, it may be beneficial to back up the diaphragm valve with a system that is sensitive to the oil level. But we can also analyze the pressure variations in container 10 and cause the valve to open when the variations exceed a preset level. This results in an increase in the pressure variations in collection manifold 9: we simply need to provide pressure sensor 37 which measures the pressure in the manifold and is connected to the engine's management system by line 38. This system is connected by line 39 to solenoid valve 40 installed in line 36, which it opens to discharge line 41 if the pressure variations measured by sensor 37 exceed a preset threshold.

It can be seen in FIG. 10 that the compartment of valve 29 containing the oil is not necessarily the lower compartment, since it is the oil pressure which distorts the diaphragm against its recoil device.

Sensing of the level can be performed by means of float 42 (FIG. 11) which closes a contact when the maximum or minimum level has been reached. The corresponding sensors, items 43 and 44 (which may be proximity sensors, magnetic switches, etc.), are connected to the engine's management system by lines 45 and 46, respectively.

Figure 12:
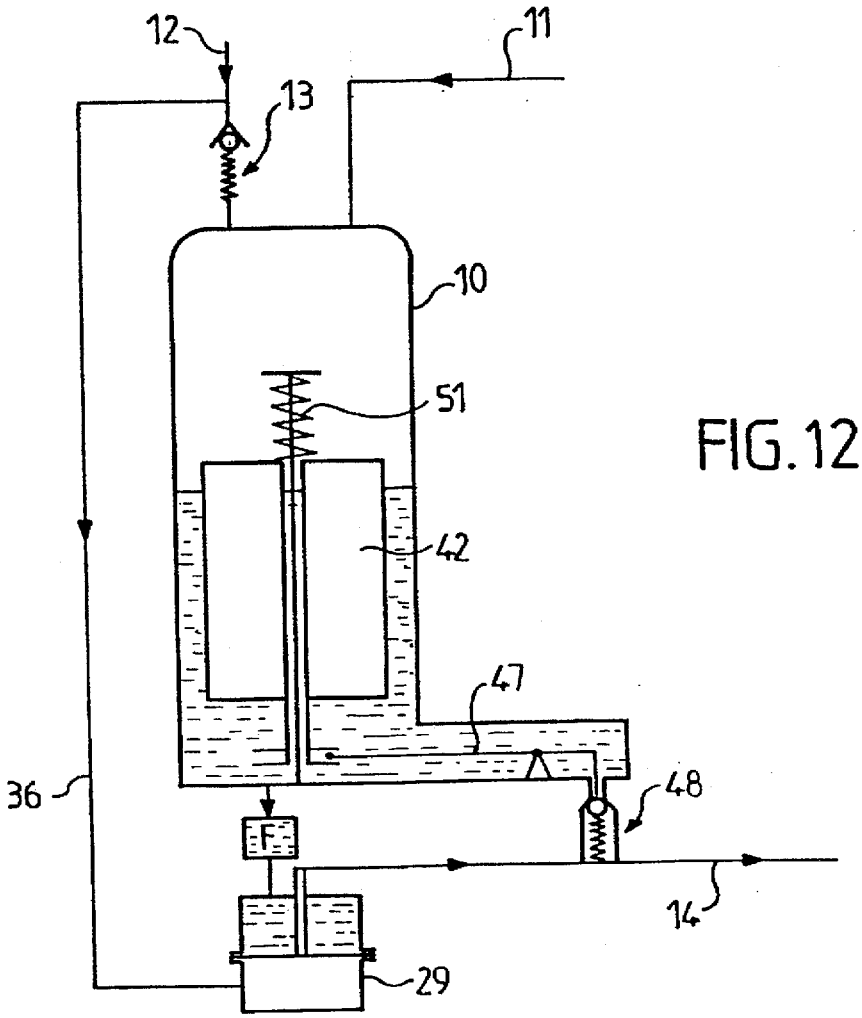

FIG. 12 shows another system providing redundancy when using a diaphragm valve installed in the same way as the one in FIG. 10. Float 42 is again present, but it is hinged at its lower end to one end of pivoted lever 47, the other end of which acts on the ball of calibrated valve 48 so as to open this valve if the oil level in container 10 rises: the oil can then escape through line 14 downstream of diaphragm valve 29. Spring 51 is provided to retain the float and prevent it from rising inadvertently under the effect of vertical accelerations of the vehicle.

Figure 13:
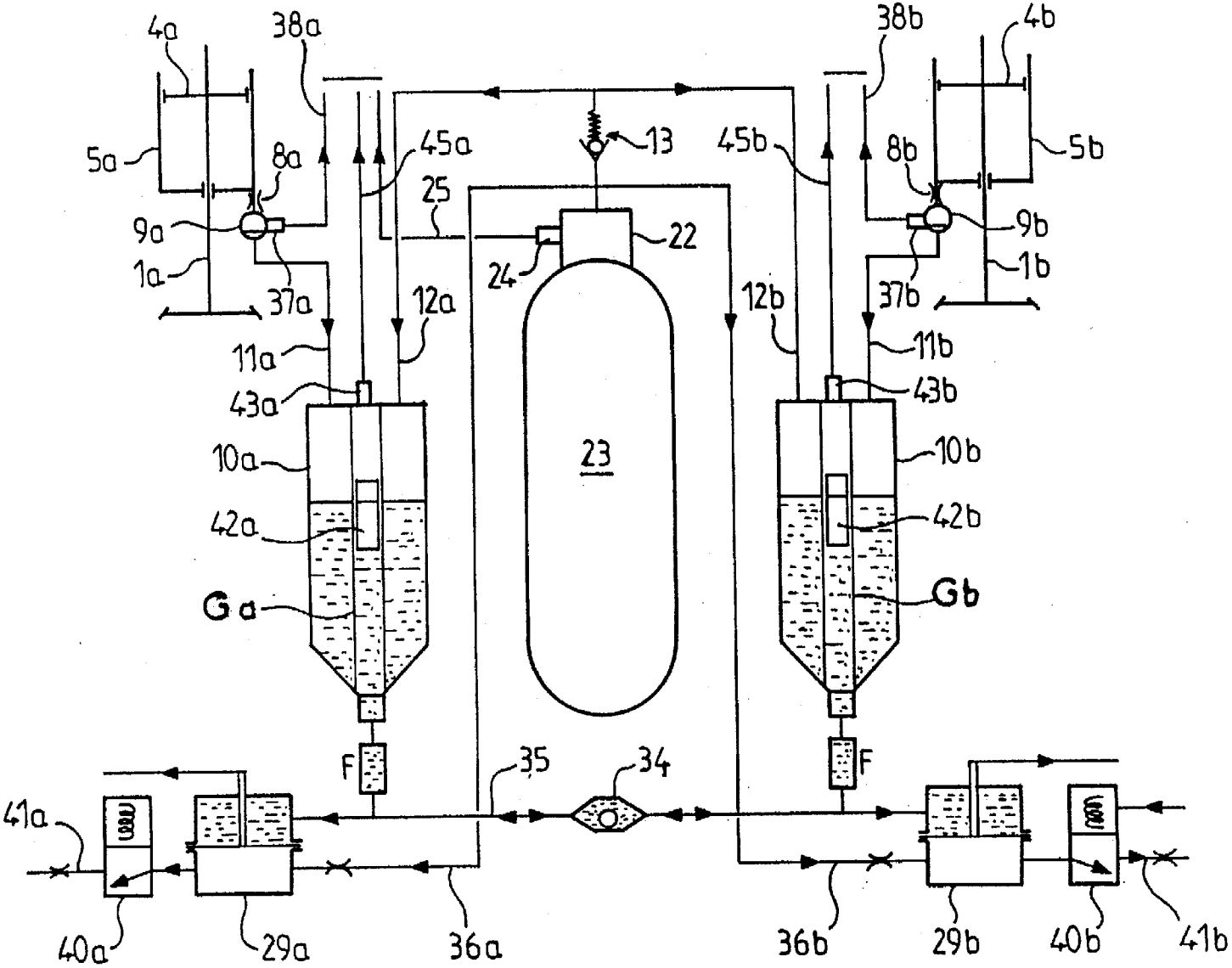
Figure 14:
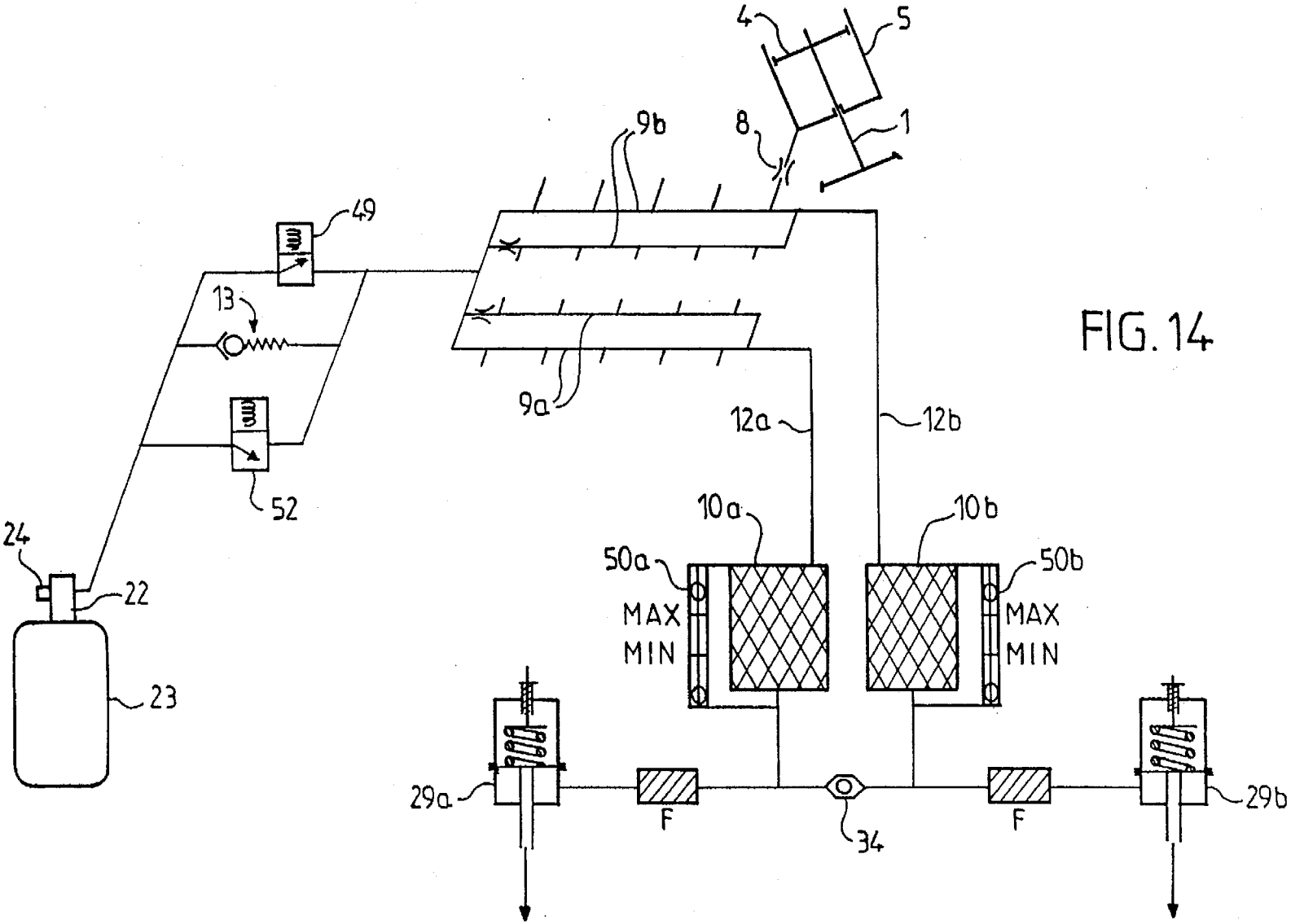

FIG. 13 shows an arrangement using two systems like the one shown in FIG. 10, which correspond to the two banks of cylinders on the engine, with tank 23 and valve 13 being common to both systems. The components already described have the same references followed by the index a or b, depending on the side. One can also provide floats **42*a* and 42*b* kept in guides Ga and Gb, in combination with level sensors 43*a* and 43*b* connected to the engine's management system by lines 45*a* and 45*b*. Of course, anti-transfer valve 34 installed in line 35 is also present as in FIG. 9**.

Note that in this variation-just as in the others—sensing of the level can be done by other means, such as by hot-wire sensors.

It is still possible for the oil to evacuate poorly from the collection manifolds, item 9, and for foam to gather in these manifolds. For this reason, the system illustrated in FIG. 14, in which valve 1 with its corresponding jack 4–5 and its calibration port 8, as well as two collection manifold assemblies **9*a* and 9*b*, has been provided. Containers 10*a* and 10*b* are not directly linked to tank 23, but instead through manifolds 9*a* and 9*b*, with valve 13 being located between tank 23 and manifolds 9. Evacuation is provided by diaphragm valves 29*a* and 29*b*, and anti-transfer valve 34** is also present.

In this setup, tank 23 (which may have a volume of 0.6 liter) is always pressurized to 200 bars, but pressure reducing valve 22 is adjusted to 15 bars and valve 13 to 5 bars (once again, in order to have approximately 10 bars in containers **10*a* and 10*b***); naturally, these values can vary according to the particular case.

At preset intervals—for example, after a certain number of engine cycles—solenoid valve 49 placed in parallel with valve 13 is opened to considerably increase the pressure in manifolds 9 and expel the foam into containers **10*a* and 10*b***.

Level sensors such as items 50*a* and 50*b* make it possible to control evacuation and adapt the opening frequency of solenoid valve 49 at all times, with solenoid valve 49 possibly being backed up by backup solenoid valve 52.

The system of this invention has numerous advantages, the main one being its simplicity both in its design as well as its operation. Indeed, there is no risk of failure or leakage at the valves, and since the system is simple, the installation time is very short.

The construction of an engine is facilitated by the fact that there are no flap valves in the cylinder head, since the systems in the cylinder head are practically limited to the collection manifold and the links between the manifold and the various chambers, on the one hand, and the oil recovery containers, on the other hand, allowing for adaptation to numerous types of engines.

In addition, oil evacuation from chambers 6 is assisted by the presence of the calibration port and, since this evacuation is performed at all times, pressure variations in the actuators are better controlled (using the flap valve system of document FR-A-2529616, evacuation is sequential).

Finally, the system of this invention reduces the load at the contact point between the cams and tappets, particularly at slow speeds, resulting in smaller mechanical losses and better deceleration.

It is understood that the invention is not limited to the embodiments described and shown herein, and that numerous variations can be imagined without exceeding the scope of this invention. In addition, the invention can apply to all types of internal combustion engines and not just to automotive engines.

What is claimed is:

1. Pneumatic valve system for internal combustion engines comprising a piston which is connected to a valve stem, which slides in a cylinder, with the piston, the valve stem, and the cylinder forming a chamber containing a compressible fluid, characterized by the fact that said chamber is linked to an oil-evacuation and fluid-pressure-regulating system outside the engine cylinder head by means of a single calibration port, wherein the oil-evacuation and pressure-regulating system includes a container whose upper portion communicates both with the calibration port and a source pressurized gas, and the lower portion where oil accumulates communicates with an evacuation line equipped with at least one device controlling evacuation of the oil.

2. Recoil system according to claim 1, wherein the calibration port is linked to a collection manifold which communicates with the oil-evacuation and pressure-regulation system.

3. Recoil system according to claim 1, wherein the diameter of the calibration port is between 0.5 and 1.5 mm.

4. Recoil system according to claim 1 further including two oil-evacuation and pressure-regulating systems in order to ensure redundancy.

5. Recoil system according to claim 4, further including an anti-transfer valve (34) capable of preventing the transfer of oil during lateral accelerations exceeding a predetermined threshold is installed between the two oil-evacuation and pressure-regulating systems.

6. Recoil system according to claim 1, wherein the upper portion of the container communicates with the source of pressurized gas through a calibrated valve.

7. Recoil system to claim 1, wherein the device controlling oil evacuation is sensitive to the pressure in said container.

8. Recoil system according to claim 1, wherein the device controlling oil evacuation is sensitive to the oil level in the container.

9. Recoil system according to claim 1, wherein the device controlling oil evacuation is a solenoid valve.

10. Recoil system according to claim 1, wherein the device controlling oil evacuation is a diaphragm valve.

11. Recoil system according to claim 10, wherein the diaphragm valve (29) includes a body (30) separated by a diaphragm (31) into one compartment into which said evacuation line (14) empties, and a second compartment containing a recoil device which presses the diaphragm (31) against the opening of a tube (33) placed in the first compartment.

12. Recoil system according to claim 11, wherein the means for recoiling the diaphragm (31) is mechanical, such as a spring (32).

13. Recoil system according to claim 11, wherein the means for recoiling the diaphragm (31) is pneumatic, with the second compartment communicating with the pressurized gas source (23, 22) through a line (36).

14. Recoil system according to claim 13, wherein said line (36) is equipped with a solenoid valve (40) which is caused to open when the pressure variations in the container (10) exceed a predetermined threshold.

15. Recoil system according to claim 14 wherein said solenoid valve (40) is controlled by an engine management system according to the indications of a sensor (37) which measures the pressure in the collection manifold (9).

16. Recoil system according to claim 8, wherein the system further includes means for detecting the oil level in the container (10).

17. Recoil system according to claim 16, wherein the means for detecting the oil level includes a float (42) capable of actuating contacts (43, 44) connected to an engine management system.

18. Recoil system according to claim 15, wherein the means for detecting the oil level includes a float (42) hinged at its lower end on the end of a lever (47) whose other end acts on the ball of a calibrated valve (48) in such a way as to open this valve if the oil level rises above a predetermined threshold.

19. Recoil system according to claim 16, wherein the means for detecting the oil level includes a hot-wire sensor.

20. Recoil system according to claim 2, wherein the system further includes means for evacuating any oil accumulating in the collection manifold (9).

21. Recoil system to claim 1, wherein the means for evacuating oil from the collection manifold includes a solenoid valve installed in parallel with said calibrated valve between the pressurized gas source and the collection manifold, with the container being installed downstream of the manifold with respect to the calibrated valve, and the solenoid valve being caused to open at predetermined intervals.

22. Recoil system according to claim 21, wherein opening of said solenoid valve (49) is controlled according to at least one of the number of engine cycles and the oil level in the container (10).

* * * * *